United States Patent [19]

Kraemer et al.

[11] Patent Number: 4,932,187

[45] Date of Patent: Jun. 12, 1990

[54] REFRACTORY ANCHOR SYSTEM AND METHOD

[76] Inventors: Robert Kraemer; Robert Kraemer, Jr., both of P.O. Box 305, Pitman, N.J. 08071

[21] Appl. No.: 312,267

[22] Filed: Feb. 21, 1989

[51] Int. Cl.[5] ..... E04B 1/38

[52] U.S. Cl. ..... 52/747; 52/506; 52/712; 411/444; 411/457

[58] Field of Search ..... 52/506, 410, 713, 698, 52/712, 747; 411/444, 457, 461, 442, 443, 469

[56] References Cited

U.S. PATENT DOCUMENTS

| | | | |
|---|---|---|---|
| 422,198 | 2/1890 | Forster | 411/444 |
| 1,782,695 | 11/1930 | Prez . | |
| 3,281,168 | 10/1966 | Dufficy | 411/457 X |
| 3,378,975 | 4/1968 | Hill | 52/713 X |
| 3,681,885 | 8/1972 | Goggins | 52/288 |
| 4,248,023 | 2/1981 | Dunlap | 52/406 |
| 4,320,605 | 3/1982 | Carlson et al. | 52/410 |
| 4,450,664 | 5/1984 | McNamee | 52/385 |
| 4,541,211 | 9/1985 | Garrett | 52/98 |
| 4,576,532 | 3/1986 | Hanson et al. | 52/506 X |
| 4,592,688 | 6/1986 | Kramer | 52/506 X |

FOREIGN PATENT DOCUMENTS

| | | | |
|---|---|---|---|
| 766464 | 1/1957 | United Kingdom | 411/457 |

*Primary Examiner*—Carl D. Friedman

*Attorney, Agent, or Firm*—Norman E. Lehrer

[57] ABSTRACT

A method for lining furnace walls with insulation is provided where a plurality of hanger assemblies which are elongated lengths of metal support members each having a plurality of elongate studs secured to one surface in a predetermined spaced alignment and which extend perpendicularly from the surface of the support member are positioned over the surface of a furnace wall by first securing one length of the metal support members horizontally adjacent the top end of a furnace wall and then sequentially vertically positioning other lengths of the metal support members on the furnace wall with the spaced aligned elongate studs extending from the surface of the support members in vertical alignment with an elongate stud extending from the surface of the horizontally positioned support member.

11 Claims, 3 Drawing Sheets

REFRACTORY ANCHOR SYSTEM AND METHOD

FIELD OF THE INVENTION

The present invention relates to hangers or anchor assemblies for supporting insulation material to a structure and, more particularly, to improved methods for securing relatively thick panel-like or sheet-like insulation materials to the refractory walls of a furnace and the like and to the hanger assemblies for use in the same.

BACKGROUND OF THE INVENTION

For many years heat treating furnaces, refractory furnaces, ceramic kilns, brick kilns, and the like, were lined with thick dense refractory brick or refractory blocks, and more recently with blankets or sheets of insulation material such as ceramic fibers made of alumina-silica, and the like, to protect the walls from extreme heat within the furnace. A common practice for anchoring the wall lining is to employ a device such as an insulation hanger in the form of an elongated stud which is welded to the furnace walls. The studs generally have teeth or notches along their sides and a retaining clip or washer having an opening therethrough in order to secure the clip to the stud after mounting or impaling insulation thereon. During the course of time, it is also necessary to replace the studs and/or remove the old insulation material and reline the furnace, as they will deteriorate during use.

Typical of such installations are the insulation hangers and installations using them shown in U.S. Pat. No. 3,738,217 to Walker; U.S. Pat. No. 4,576,532 to Hanson et al.; and U.S. Pat. No. 4,592,688 to Kramer. In all such installations it is required to individually position and weld the elongated studs over the surface of the wall to be protected, the studs extending perpendicularly from the wall surface with the open ends thereof capable of receiving the insulation material. The location and spacing arrangement of the studs is important to insure that the entire wall surface is protected and the insulation material used can be properly supported and anchored.

Heretofore, even though conventional welding techniques could be employed for anchoring the studs, it was necessary to arrange for the placement and spacing of each stud and to weld each stud separately through the use of a stud weld gun as well as checking the quality of the weld to avoid premature failure during use of the furnace. Accordingly, considerable labor and expense must be incurred in new installations or in reweldng studs when relining a furnace. In addition, the furnace must be shut down and is out of operation during the time needed to effect the insulation installation or replacement.

SUMMARY OF THE INVENTION

It is an object of the present invention to provide a method for installing and anchoring insulation to the wall of a refractory furnace and the like which is efficient and safe including a relatively simple, effective means for positioning and anchoring insulation hangers to the furnace.

It is a further object to provide a method for installing and anchoring insulation hangers for supporting insulation lining material capable of adjustment for varying sizes of lining material and which can be reused during relining which is efficient and safe and will reduce the time that the furnace is out of operation.

It is a still further object to provide a method for installing and anchoring insulation hangers for supporting insulation lining material on the wall of a furnace which includes a simple and effective means for insuring the quality of the weld anchoring the insulation hangers to the furnace wall.

Still another object is to provide an insulation hanger assembly in which a plurality of insulation hangers are in a predetermined spaced alignment suitable for installation and anchoring to the wall of a furnace.

In accordance with the present invention there is provided a method for lining furnace walls with panel-like and sheet-like insulation which comprises:

(a) providing a plurality of elongated lengths of metal support members having a first substantially planar surface adapted to be attached to the surface of a furnace wall and a second opposite substantially planar surface, each of said support members having a plurality of elongate end weldable studs welded to said second surface in a predetermined spaced alignment and perpendicularly extending from the second opposing surface of said metal support member;

(b) positioning one of said elongated support members substantially horizontally adjacent the top end of a wall of said furnace and securing said first planar surface of said support member to said furnace wall;

(c) vertically positioning a second of said elongated support members with the first planar surface thereof on the surface of said furnace wall below said horizontally mounted first support member with the plurality of spaced, aligned elongate studs extending from the second opposite surface of said second support member in substantial vertical alignment with an elongate stud extending from the second surface of said first support member and securing the first surface of said second support member to the surface of said furnace wall;

(d) repeating step (c) with other of said support members until a support member is vertically positioned on the surface of the furnace wall in alignment with each of the elongate studs extending from said horizontally positioned first support member.

In another aspect of the present invention there is provided a hanger assembly for supporting a panel-like and sheet-like insulation comprising:

(a) an elongated metal support member having a first substantially planar surface adaptable for securing to a wall surface and a second opposite substantially planar surface;

(b) a plurality of elongate end weldable studs in a predetermined spaced alignment, one end of each of said studs being anchored by welding to the second opposite surface of said support member and extending substantially perpendicularly from said support member.

The hanger assembly of the present invention may be efficiently fabricated without the need to shut down a furnace to be insulated and then can be installed on the wall of a furnace by a simple and effective method in accordance with the present invention. The elongate stud hangers can be readily anchored to the support member by conventional welding techniques and the quality of each of the stud anchoring welds can be determined before the use thereof in a furnace. The hanger assembly may be universally employed for any thickness of lining material and can be reused for a new lining assembly.

Other objects and advantages of the present invention will become apparent from the detailed description thereof taken in conjunction with the drawing.

BRIEF DESCRIPTION OF THE DRAWING shown in the accompanying drawings one form which is presently preferred; it being understood that the invention is not intended to be limited to the precise arrangements and instrumentalities shown.

Figure 4:
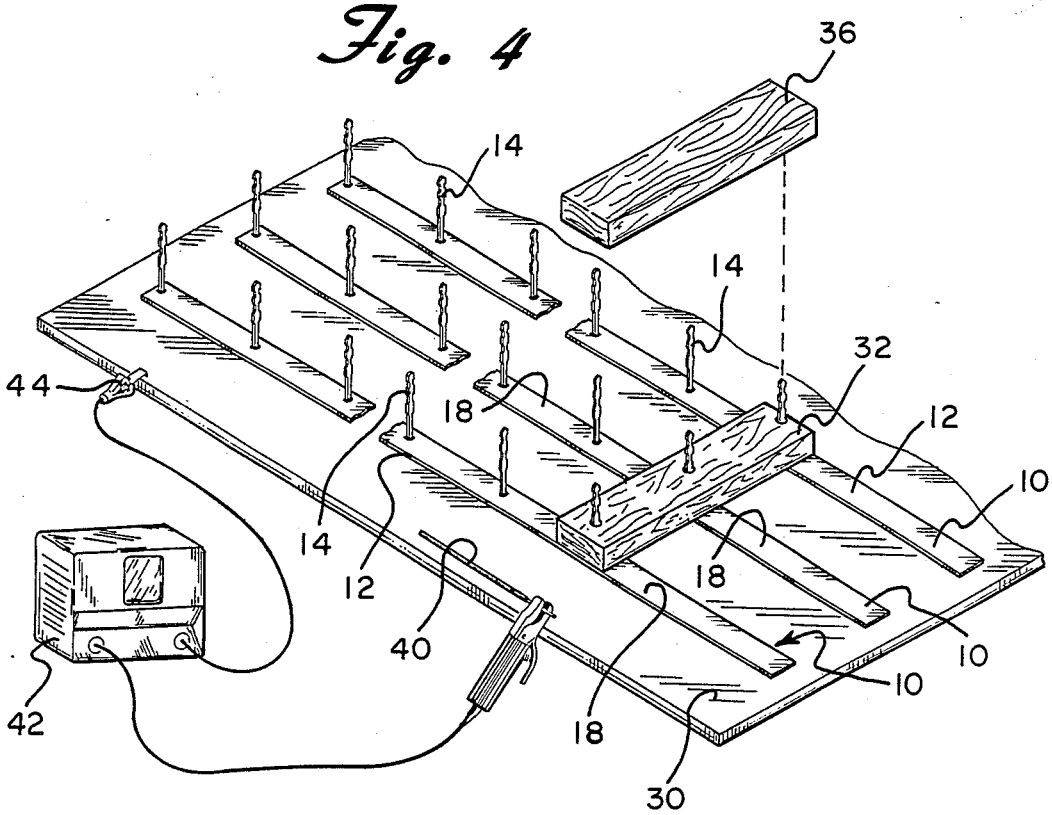
Figure 5:
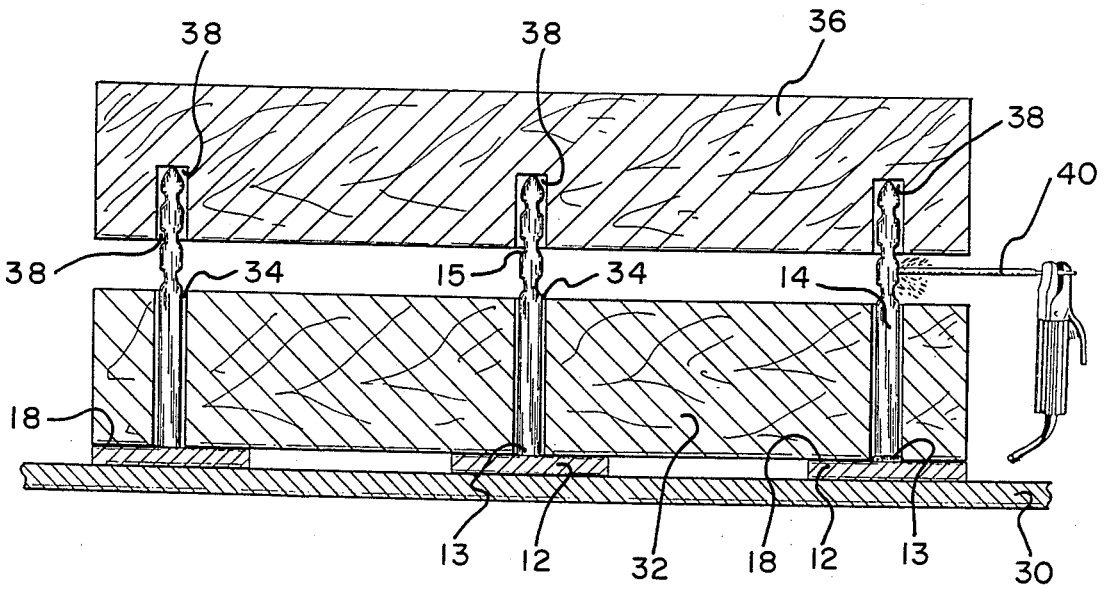
Figure 6:
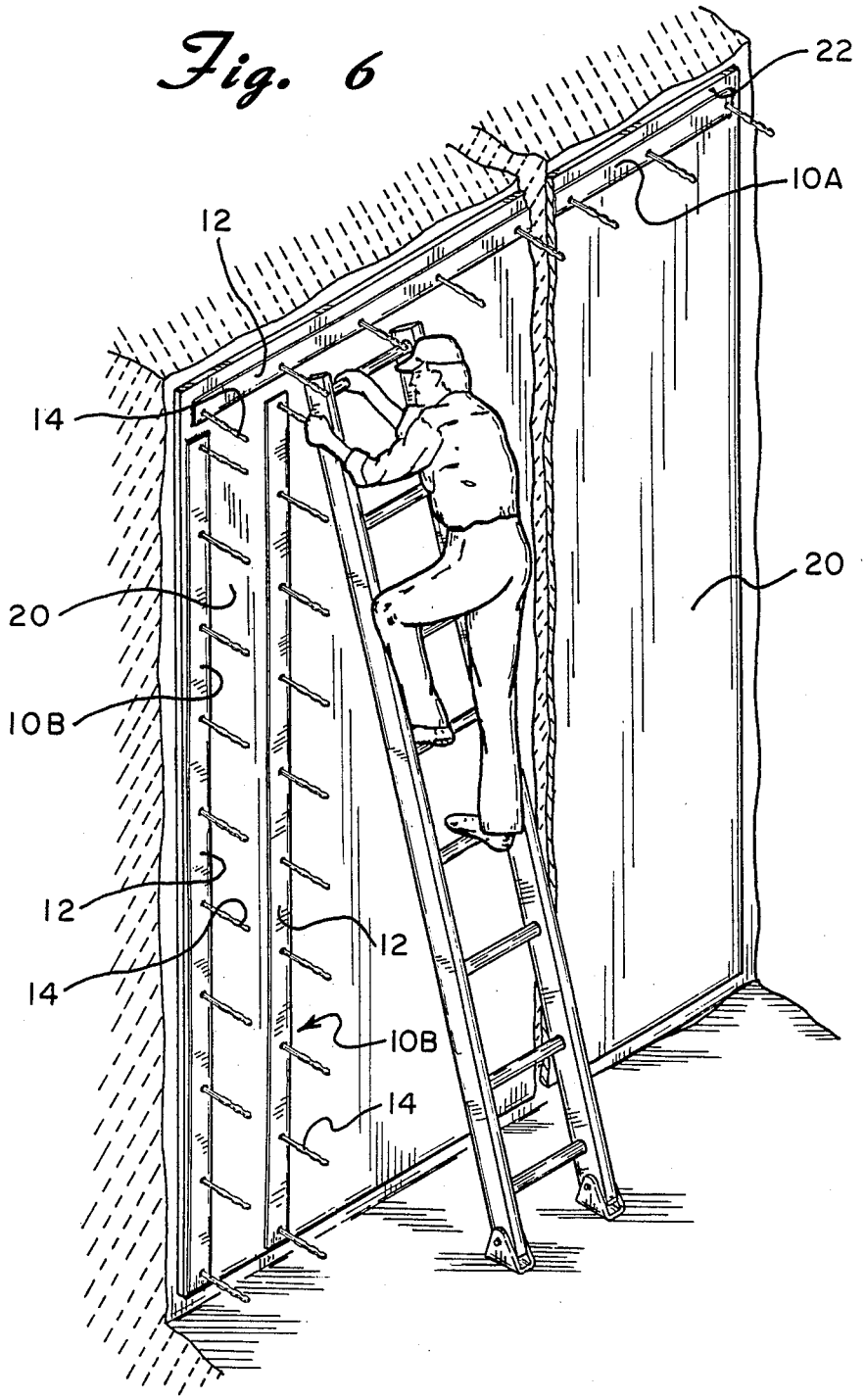

FIG. 4 a perspective view, part broken away, illustrating a me of fabricating by welding of a hanger assembly of the invention;

FIG. 5 is a sectional view illustrating the method of supporting elongate end weldable studs during the welding of the studs to a member to fabricate hanger assemblies of the invention, and FIG. 6 is a perspective view of the wall of a furnace illustrating the method of the invention.

DESCRIPTION OF THE PREFERRED EMBODIMENT

Figure 1:
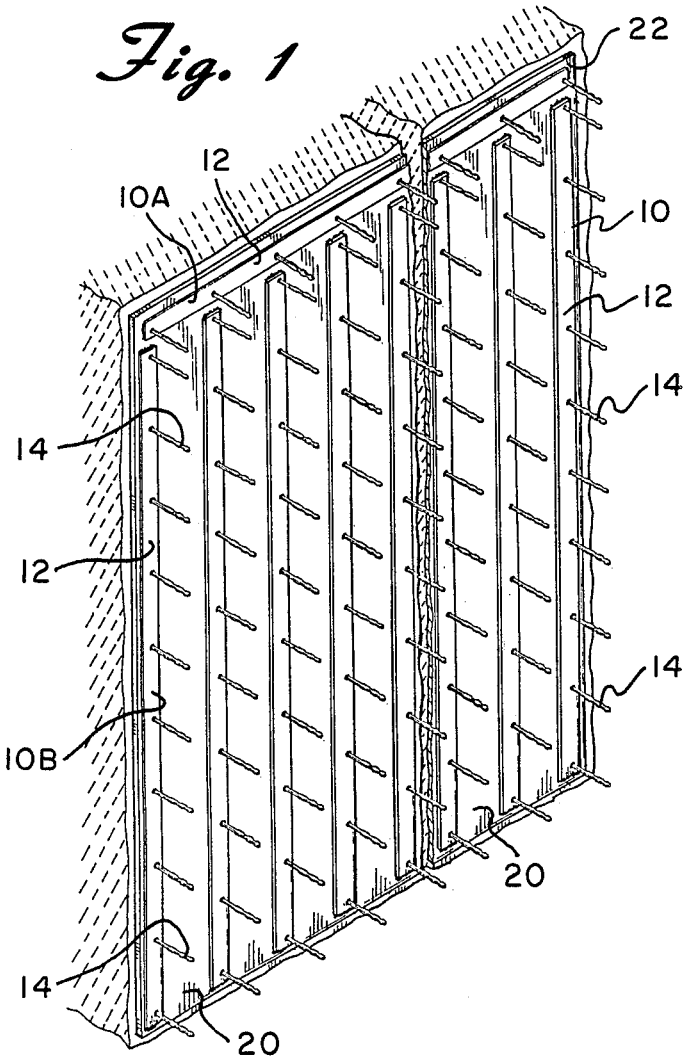
FIG. 1 is a perspective view, part in section and part broken away, of the wall of a furnace with hanger assemblies of the invention mo thereon in accordance with the method of the invention.

Referring to the drawings, where like reference numerals identify like parts, there is shown in FIG. 1 the hanger assembly of the present invention in assembled position on the wall of a furnace in accordance with the practice of the invention. The invention is concerned with an efficient and safe way of installing and anchoring insulation to the wall of a furnace which includes a relatively simple, effective means for positioning and anchoring insulation hangers to the furnace.

Figure 2:
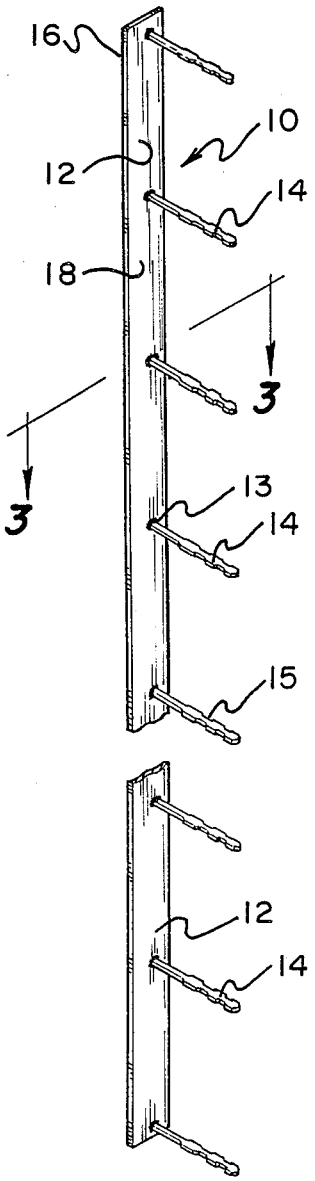
FIG. 2 is a perspective view, part broken away, of a hanger assembly of invention.
Figure 3:
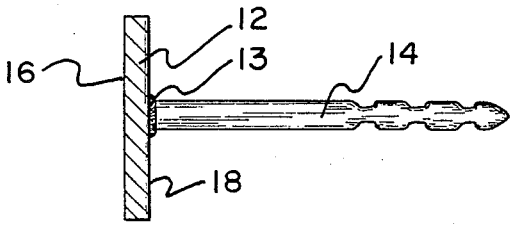
FIG. 3 is a sectional view taken along the line 3—3 of FIG. 2.

The hanger assembly 10 (FIG. 2) includes an elongated metal support member 12 having a plurality of elongate end weldable studs 14, which are end welded at one end 13 (FIG. 3) to the metal support member 12 by an end welding technique to be described in greater detail hereinafter. The studs 14 are anchored to the metal support member 12 in a predetermined spaced, aligned array (FIG. 2), generally about 10 inches apart.

FIG. 1 shows the wall of the structure to be lined, i.e. the metallic wall 20 of a furnace. The wall 20 has an array of hanger assemblies 10 affixed thereto by spot welding or the like. As indicated, the hanging assemblies 10 are preassembled with elongate studs 14 arranged in a predetermined spaced alignment and end welded to an elongated support member 12 prior to the time it is mounted on the furnace wall 20. The hanging assemblies 10 are mounted on the wall 20 in accordance with the practice of the invention (see FIG. 6) with each of the elongate studs 14 perpendicularly extending from the wall 20 in a spaced vertical alignment. To achieve such objectives, a first hanging assembly 10A is horizontally affixed to the top end 22 of the wall 20 by spot welding of the support member 12 to the wall 20. One hanging assembly 10B at a time in then vertically positioned below the horizontally positioned hanging assembly 10A with the spaced, aligned array of studs 14 extending from the vertically positioned hanging assembly 10B in vertical alignment with an elongate stud extending from the horizontally positioned hanging assembly 10A. As shown, this can be readily accomplished by the installer grasping the stud extending from the top end of the hanging assembly 10B, positioning the stud below the appropriate stud extending from horizontally positioned hanging assembly 10A, and then permitting the weight of the hanging assembly 10B to self-plumb its vertical alignment. The vertically positioned hanging assemblies 10B are affixed to the wall 20 by spot welding or the like of the support member 12 to the wall 20. The spacing between stud 14 extending from the top end of the hanging assembly 10B and the stud 14 extending from hanging assembly 10A aligned therewith is generally different from that of the spaced studs 14 extending from the vertically mounted hanging assemblies 10A and is not critical.

Referring now to FIGS. 2 to 5, there is shown a hanging assembly 10 of the invention which includes an elongated metal support member 12 having a first substantially planar surface 16 which is adaptable to be attached to the surface of a furnace wall and the like and a second opposite substantially planar surface 18. A plurality of elongate end weldable studs 14 are end welded at one end 13 to the support member 12, generally to the second opposite planar surface thereof, in a predetermined spaced aligned array. The spacing between each of the studs may vary depending on the size and type of insulation to be mounted thereon and the size and type of furnace in which the insulation is to be employed. A typical installation will generally use studs spaced about 10 inches apart. The length, width and thickness of the support member 12 may also vary depending on the particular insulation application, with a typical installation employing about 10 feet long support members 12 which may be about 3 to 6 inches wide and are thick enough to be easily transported without bending or breaking.

In FIGS. 4 and 5 are shown a preferred method of welding the studs 14 to the support member 12 wherein a plurality of support members 12 are positioned on a metal welding plate 30. A support block 32 made of wood or the like with spaced holes 34 formed therethrough is used to position and hold a plurality of elongate studs in vertical contact with the second planar surface of support members 12 positioned on the welding plate 30. A cover block 36 with recesses 38 formed in one surface thereof which are in register with the holes 34 in support block 32 is used to cover the open end of the elongate stud 14 to provide further support for the studs during the welding operation as well as to insure that by suitable application of pressure by the operator on the top surface of cover block 36, the weldable end 13 of the stud 14 is maintained in contact with the support member 12. When positioned over the ends of the elongate studs, the cover block 36 will be spaced from the support block 32 a distance sufficient to permit a welding rod 40 to contact the stud and effect a suitable weld between the weldable end 13 of the stud and the support member 12. Conventional end welding apparatus 42 can be employed with one terminal thereof 44 being connected to the welding plate 30 upon which support members 12 are positioned. The welded joints between the weldable end 13 of the studs 14 and the support bars 12 can thus be quickly formed with the quality thereof and the positioning of the studs being effectively assured.

The studs 14 shown are substantially rectangular in cross section having one pair of opposed sides narrower than the other pair. A plurality of opposed notches 15 are disposed along the end of the stud opposite its welding end and are cut into the narrower sides of the stud. A substantial flat clip (not shown) designed to pass over the end of the stud in the manner disclosed in U.S. Pat. No. 3,738,317 would provide support for insulation to be mounted on the stud. It would be evident to one skilled in the art that any of the known insulation studs commercially available and disclosed, for example, in U.S. Pat. Nos. 3,738,217, 4,576,532 and 4,592,688 may also be used in accordance with the present invention.

Having thus described the invention in relation to the drawings hereof, it will be clear that modifications could be made in the preferred embodiment without departing from the spirit of the invention. Accordingly, it is not intended that the words used to describe the invention be limiting thereof nor should the drawings be considered so. It is intended that the invention be limited only by the scope of the appended claims.

What is claimed is:

1. A method for lining furnace walls with panel-like and sheet-like insulation which comprises:

(a) providing a plurality of elongated lengths of metal support members having a first substantially planar surface adapted to be attached to the surface of a furnace wall and a second opposite substantially planar surface, each of said support members having a plurality of elongate weldable studs welded to said second surface in a predetermined spaced alignment and extending perpendicularly from the second surface of said metal support member;

(b) positioning one of said elongated support members substantially horizontally adjacent a top end of a wall of said furnace and securing said first planar surface of said support member to said furnace wall;

(c) vertically positioning a second of said support member with the first planar surface thereof on the surface of said furnace wall below said horizontally mounted first support member with the plurality of spaced aligned elongate studs extending from the second opposite surface of said second support member in substantial vertical alignment with an elongate stud extending from the second surface of said first horizontally positioned support member and securing the first surface of said second support member to the surface of said furnace wall;

(d) repeating step (c) with other of said support members until a support member is vertically positioned on the surface of the furnace wall in alignment with each of the elongate studs extending from said horizontally positioned first support member.

2. The method according to claim 1 wherein said support members are secured to the wall surface of the furnace by spot welding.

3. The method according to claim 1 wherein in step (c) said second support member is vertically positioned by grasping an elongate stud at one end of said support member, positioning said stud beneath and in vertical alignment with an elongate stud extending from said first horizontally positioned support member and permitting the opposite end of said second support member to become vertically aligned therewith.

4. The method according to claim 1 which includes positioning a lining of insulation material on the elongate studs extending from the surface of the furnace wall.

5. A hanger assembly for supporting a panel-like and sheet-like insulation comprising:

(a) a single elongate substantially flat metal support member having a first substantially planar surface adaptable for securing to a wall surface and a second opposite substantially planar surface;

(b) a plurality of elongate end weldable studs in a predetermined spaced alignment, one end of each of said studs being mounted on and anchored by welding to the second opposite surface of said support member and the opposite free end thereof extending outwardly substantially perpendicularly from said second surface of said support member.

6. The hanger assembly according to claim 5, wherein said elongate studs are aligned in a single row.

7. The hanger assembly according to claim 6, wherein said elongate studs extend over substantially the length of said support member.

8. The hanger assembly according to claim 5, wherein said elongate studs have opposed notches disposed along an end of the studs opposite its welding end.

9. A method for lining furnace walls with panel-like and sheet-like insulation which comprises:

(a) providing a plurality of elongated lengths of metal support members having a first substantially planar surface adapted to be attached to the surface of a furnace wall and a second opposite substantially planar surface, each of said support members having a plurality of elongate weldable studs welded to said second surface in a predetermined spaced alignment and extending perpendicularly from the second surface of said metal support member;

(b) vertically positioning a first of said support members with the first planar surface thereof disposed on a furnace wall surface and one end thereof being adjacent a top end of said furnace wall wherein the plurality of spaced aligned elongate studs extending from the second opposite surface of said first support member are in substantial vertical alignment, and securing the first surface of said first support member to the surface of said furnace wall;

(c) repeating step (b) with other of said support members until a plurality of support members are secured to said surface of the furnace wall in a substantially uniformly spaced vertical alignment.

10. The method according to claim 9, wherein in step (b) said first support member is vertically positioned by grasping an elongate stud at a first end of said support member, positioning said first end of the support member adjacent the top end of the furnace wall and permitting the opposite end of said support member to become vertically aligned said first end.

11. The method according to claim 9 which comprises providing guide means disposed substantially horizontally adjacent the top end of said furnace wall and said support members are positioned on said furnace wall surface in substantially uniformly spaced vertical alignment in accordance with said guide means.

* * * * *